US008597007B2

(12) United States Patent
Kothnur et al.

(10) Patent No.: US 8,597,007 B2
(45) Date of Patent: Dec. 3, 2013

(54) SCREW PUMP ROTOR AND METHOD OF REDUCING SLIP FLOW

(75) Inventors: Vasanth Srinivasa Kothnur, Clifton Park, NY (US); David Deloyd Anderson, Glenville, NY (US)

(73) Assignee: General Electric Company, Schenectady, NY (US)

( * ) Notice: Subject to any disclaimer, the term of this patent is extended or adjusted under 35 U.S.C. 154(b) by 176 days.

(21) Appl. No.: 13/021,106

(22) Filed: Feb. 4, 2011

(65) Prior Publication Data

US 2011/0123378 A1 May 26, 2011

Related U.S. Application Data

(62) Division of application No. 11/673,148, filed on Feb. 9, 2007, now abandoned.

(51) Int. Cl.

| | |
|---|---|
| ***F01C 1/16*** | (2006.01) |
| ***F03C 2/00*** | (2006.01) |
| ***F03C 4/00*** | (2006.01) |

(52) U.S. Cl.
USPC ..... 418/201.1; 418/104; 418/113; 418/142; 418/220; 277/354; 277/372

(58) Field of Classification Search
USPC ..... 418/201.1–201.3, 104, 113, 140, 142; 277/354, 372, 370, 529, 580, 586, 644, 277/641
See application file for complete search history.

(56) References Cited

U.S. PATENT DOCUMENTS

| | | | | |
|---|---|---|---|---|
| 2,195,886 | A * | 4/1940 | Hawley, Jr. | 418/113 |
| 4,871,304 | A | 10/1989 | Iida et al. | |
| 5,533,887 | A | 7/1996 | Maruyama et al. | |
| 5,738,505 | A | 4/1998 | Mezzedimi et al. | |
| 5,779,451 | A | 7/1998 | Hatton | |
| 6,406,281 | B1 | 6/2002 | Aggradi et al. | |
| 7,401,655 | B2 | 7/2008 | Vandevier et al. | |
| 2010/0040499 | A1 | 2/2010 | Anderson et al. | |

FOREIGN PATENT DOCUMENTS

| | | | |
|---|---|---|---|
| DE | 455967 | C | 2/1928 |
| DE | 855946 | C * | 11/1952 |
| DE | 4221199 | A1 | 2/1993 |
| GB | 342791 | | 1/1930 |
| JP | 58073990 | U1 | 5/1983 |

(Continued)

OTHER PUBLICATIONS

JP Office Action dated Aug. 14, 2012 from corresponding JP Application No. 2008-023421.

(Continued)

*Primary Examiner* — Theresa Trieu
(74) *Attorney, Agent, or Firm* — Global Patent Operation

(57) ABSTRACT

A pump rotor for a screw pump includes a shaft, a first set of threads disposed on a portion of an outer surface of the shaft, at least one thread of the first set of threads including a groove disposed on an end portion thereof, and a ring seal disposed on the groove such that the ring seal is configured to protrude outwardly from the groove and to rest against an inner surface of a liner of the screw pump, and the groove is sized so as to allow the ring seal to move radially with respect to the plurality of threads as the rotor is deflected.

12 Claims, 6 Drawing Sheets

(56) References Cited

FOREIGN PATENT DOCUMENTS

| | | | |
|---|---|---|---|
| JP | 4073654 | U1 | 6/1992 |
| JP | 6307360 | A | 11/1994 |
| JP | 2004183752 | A | 7/2004 |
| RU | 2166986 | C2 | 5/2001 |
| SU | 160593 | A3 | 11/1990 |
| WO | 2005071292 | A1 | 8/2005 |

OTHER PUBLICATIONS

Russian Office Action dated Dec. 23, 2011 from corresponding RU Applicatio No. 200810491 along with unofficial English translation.

* cited by examiner (BACKGROUND ART)

(BACKGROUND ART)

SCREW PUMP ROTOR AND METHOD OF REDUCING SLIP FLOW

BACKGROUND OF THE INVENTION

1. Field of the Invention

The present invention relates in general to screw pumps, and, more particularly, to improved screw pump rotors and methods of reducing slip flow in screw pumps.

2. Description of the Related Art

In the exploration for oil and gas the need to transport fluids (oil, water, gas, and foreign solids) from a wellhead to distant processing and/or storage facilities (instead of building new processing facilities near the wellheads) is well understood. Twin-screw pumps are increasingly being used to aid in the production of these wellhead fluids, resulting in increased production by lowering the pressure at the exit of the wellhead as well as a greater total recovery from the reservoir by allowing lower final reservoir pressures before abandoning production.

FIG. 1 illustrates a conventional twin-screw pump 10. This figure is presented simply to illustrate the main components of a twin-screw pump and should not be considered as limiting the invention disclosed herein in any way. As illustrated, the twin-screw pump 10 has two rotors 12 and 14 that are disposed within a close-fit casing or pump housing 16. Each rotor has a shaft 18A and 18B with one or more outwardly extending sets of screw threads 20 for at least a portion of the length of the shaft. The shafts 18A and 18B run axially within two overlapping cylindrical enclosures, collectively, a rotor enclosure, or liner, 19. The two rotors 12, 14 do not touch each other, but they have threads of opposed screws that are intertwined. Pump 10 will often be driven by a motor (not shown), which rotates rotors 12 and 14. A drive gear 22 on one of the shafts engages a second gear on the other shaft, such that, when the pump motor turns rotor 12, rotor 14 is turned at the same rate, but in an opposite direction. In operation, wellhead fluids, including particulate materials, are drawn into pump 10 at inlet 24. As the rotors 12 and 14 are turned, the threads 20, or more properly, rotor chambers 26 formed between adjacent threads 20 displace the wellhead fluids along the rotor shafts 18A and 18B towards an outlet chamber 28, which is the point of greatest pressure at the center of the rotors, from where the wellhead fluids are finally discharged from an outlet 30 of the pump 10. The rotor chambers 26 are not completely sealed, but under normal operating conditions the normal clearance spaces that exist between the rotors 12,14 and between each rotor and the rotor enclosure 19 are filled with transport fluid. The liquid portion of the transport fluid in these clearance spaces serves to limit the leakage of the pumped fluids between adjacent chambers. The quantity of fluid that does escape from the outlet side of the rotor back toward the inlet represents the pump slip flow, which is known to decrease the pump volumetric efficiency. As illustrated in FIG. 2 and just explained, pump slip flow (illustrated by the arrows in FIG. 2) can occur between each rotor and the rotor enclosure 19. As understood by those of ordinary skill in the art, other slip paths include slip between screw tip and adjacent rotor and between faces.

As understood by those of ordinary skill in the applicable arts, conventional twin-screw multiphase pumps face significant challenges. Consider for example, the following exemplary problems. First, assuming a fixed pressure rise per stage, as the total pressure rise requirement increases, the rotor length has to increase, resulting in an increased rotor deflection under the imposed pressure loading thereby creating a more eccentric alignment of the screws within the liner resulting in excessive slip between the screw rotor and the pump liner, if not contact and rubbing. Secondly, as the pump slip flow increases, sand particulates trapped in the slip flow leads to increased erosion/abrasion within the pump, particularly at the rotor tips by a phenomenon referred to as jetting. Such erosion/abrasion further leads to deterioration of the clearance profile and an increase in the pump slip flow. Finally, during periods of operation in which the transported fluids have a high gas-volume fraction, the temperature of the flow exiting the pump rises due to the heat generated during compression, leading to reduced clearances in the last pump stages due to variations in thermal expansion of the various pump parts, thereby possibly resulting in catastrophic seizure.

It would therefore be desirable to develop a pump rotor that will minimize or eliminate pump slip flow, resulting in a high differential pressure boost multiphase pump with a compact rotor length. In addition, better sealing between the edges of the rotor and the pump casing will also insure a reduction in solid particulate erosion/abrasion within clearances. Finally, having the ability to accommodate differences in thermal expansion as may occur when boosting high gas-volume fraction fluids may also reduce the likelihood of catastrophic seizures.

BRIEF SUMMARY OF THE INVENTION

One or more of the above-summarized needs and others known in the art are addressed by pump rotors for screw pumps, the rotors including a shaft, a first set of threads disposed on a portion of an outer surface of the shaft, at least one thread of the first set of threads comprising a groove disposed on an end portion thereof, and a ring seal disposed on the groove.

In another aspect of the disclosed inventions, twin-screw pumps are disclosed that include a casing having an inlet and an outlet, a liner disposed inside of the casing, and two rotors disposed inside of the liner, each rotor having a shaft, a set of threads disposed on a portion of an outer surface of the shaft, at least one thread of the first set of threads comprising a groove disposed on an end portion thereof, and a ring seal disposed on the groove.

Methods of reducing slip flow in a screw pump are also within the scope of the embodiments of the invention disclosed, the screw pump having a casing having a low-pressure inlet and a high-pressure outlet, a liner disposed inside of the casing, and a rotor disposed inside of the liner having a shaft and a first set of threads disposed on a portion of an outer surface of the shaft, such methods including the steps of forming a groove on end portions of at least one thread of the first set of threads, and disposing a ring seal on the groove, the ring seal being configured to protrude outwardly from the groove and to rest against an inner surface of the liner of the screw pump, the groove being sized so as to allow the ring seal to move radially with respect to the at least one thread as the rotor is deflected, and the ring seal being configured to reduce the slip flow from the high-pressure outlet to the low-pressure inlet.

The above brief description sets forth rather features of the present invention in order that the detailed description that follows may be better understood, and in order that the present contributions to the art may be better appreciated. There are, of course, other features of the invention that will be described hereinafter and which will be for the subject matter of the appended claims.

In this respect, before explaining several preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
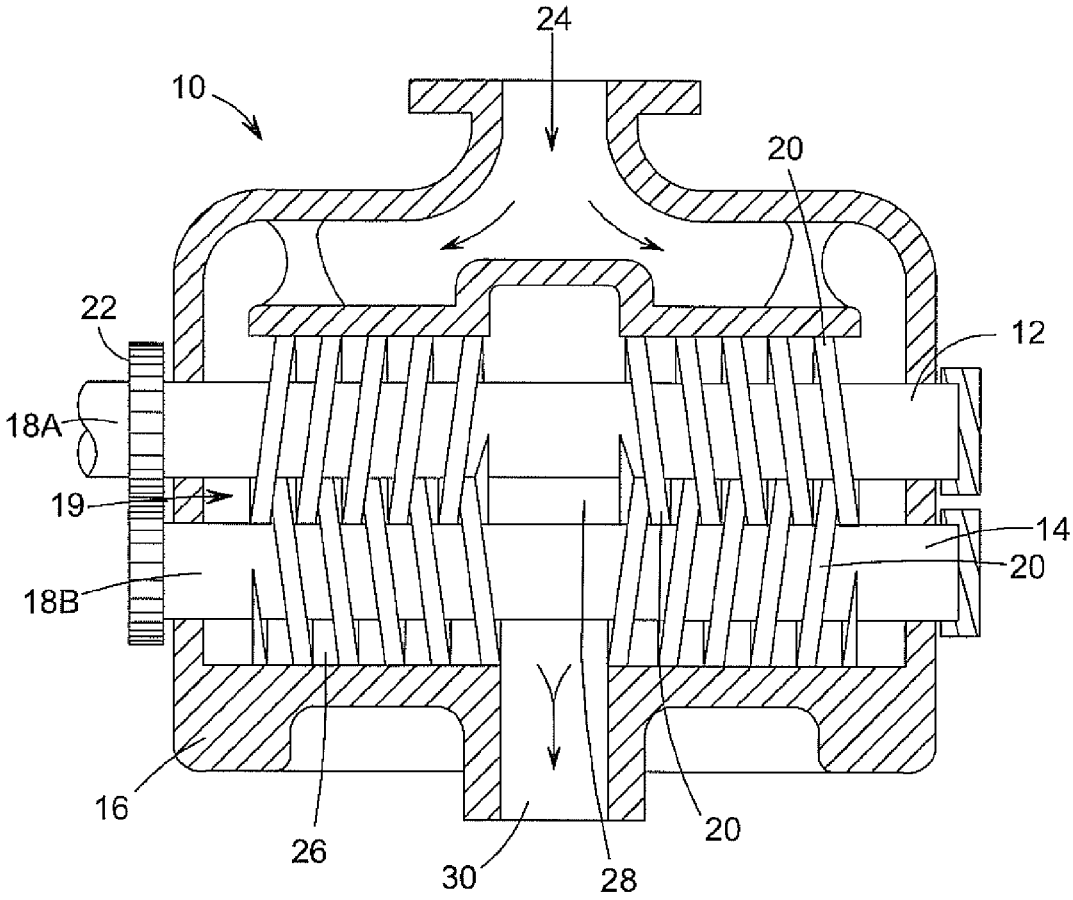
FIG. 1 illustrates a conventional twin-screw pump.
Figure 2:
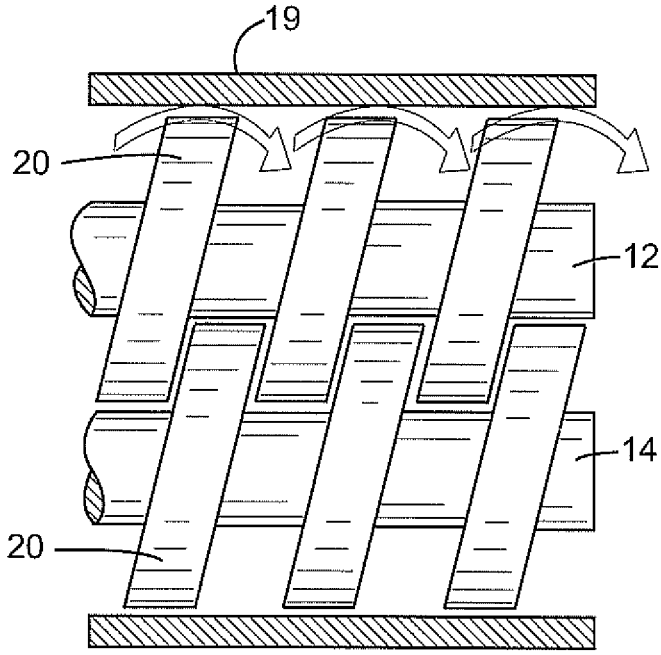
FIG. 2 illustrates the pump slip flow path between rotor tips and the liner.

Referring now to the drawings, wherein like reference numerals designate identical or corresponding parts throughout the several views, several embodiments of the pump rotor according to the disclosed invention will be described. One of the advantageous aspects of the disclosed invention is the use of a rotating inter-stage ring or brush seal to minimize and/or eliminate pump slip flow, thus providing for higher pressure rise per stage while being compliant to accommodate rotor deflections.

Figure 3:
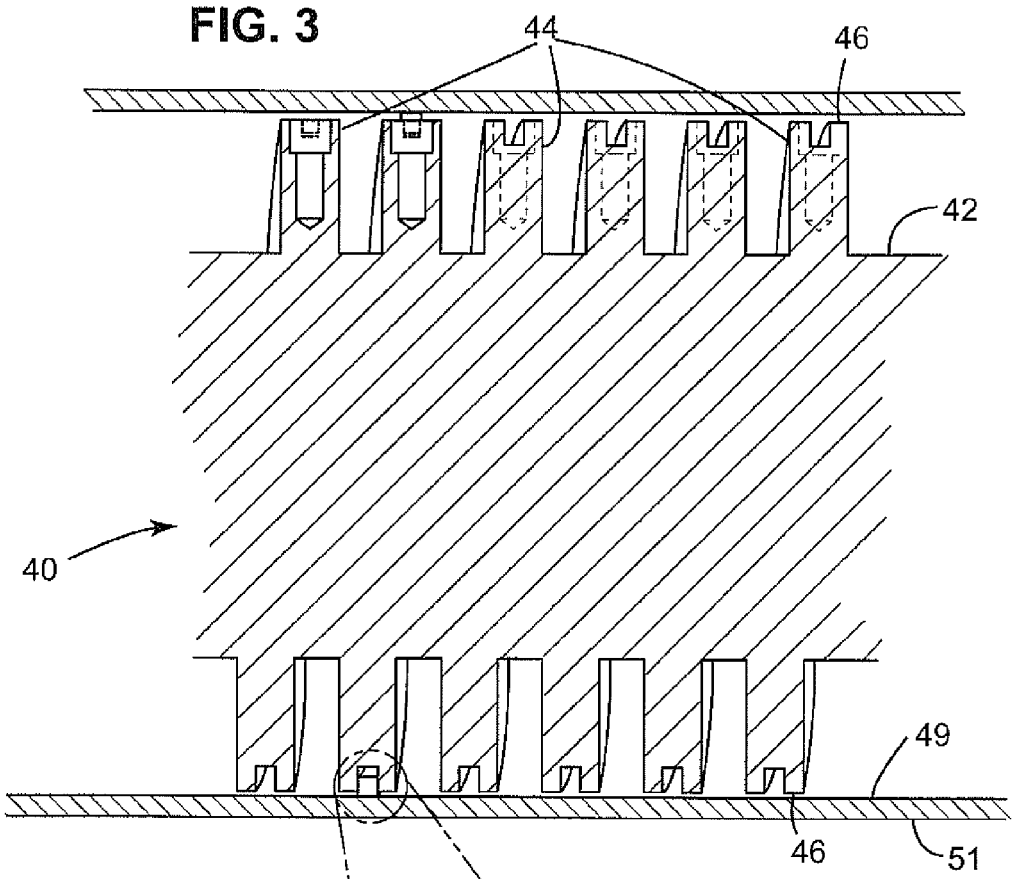
FIG. 3 illustrates a cross section view of a rotor in accordance with an embodiment of the invention.
Figure 4:
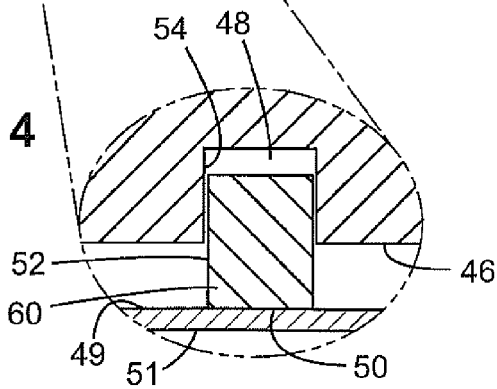
FIG. 4 illustrates a close up view of a rotor tip of the rotor of FIG. 3.
Figure 5:
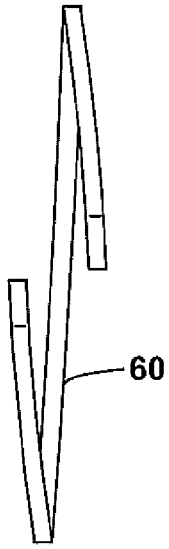
FIG. 5 illustrates a ring seal disposed on the rotor of FIGS. 3 and 4.

FIGS. 3-5 illustrate, respectively, a cross section view of a rotor 40, a cross sectional view of one tip of the screw threads of FIG. 3, and a ring seal 60 in accordance with an embodiment of the disclosed invention. Throughout this disclosure, the terms "ring seal," "piston-ring seal," "brush seal," "inter-stage seal," "split-ring seal," or "seal" will be used interchangeably. As shown in FIG. 3, the rotor 40 includes a shaft 42, on the periphery of which a plurality of screw threads 44 is disposed. At the tip 46 of the screw threads 44 a groove 48 is provided, inside of which the ring seal 60 is disposed. In one embodiment the ring seal 60, when installed and under normal operation conditions, is designed so as to spring outward, resting against an inside surface 49 of the pump liner 51. In operation, as the rotor turns and a profile of increasing pressure develops across the pump, the elimination and/or minimization of pump slip flow is accomplished by an outer surface 50 of the ring seal 60 being pushed against the inside surface 49 of the pump liner 51 by the springing action of the resilient ring seal 60 as well as a centrifugal load on the ring seal 60 caused by the rotation of the rotor 40 while a side surface 52 of the ring seal 60 is pushed against an inner surface 54 of the groove 48 by the pressure difference from one side of the ring seal 60 to the other. As shown, the seal is installed on the rotor (unlike conventional applications elsewhere in gas turbine/steam turbines where seals are disposed on the stator), generating a rotating seal between the successive pressure rise stages of a twin-screw pump.

The ring seal 60 is helical in structure and may have a length to cover any specific amount of circumferential displacement of the helical threads 44 of the rotor 40. FIG. 5 illustrates a ring seal 60 covering a complete revolution of the threads 44.

Figure 6A:
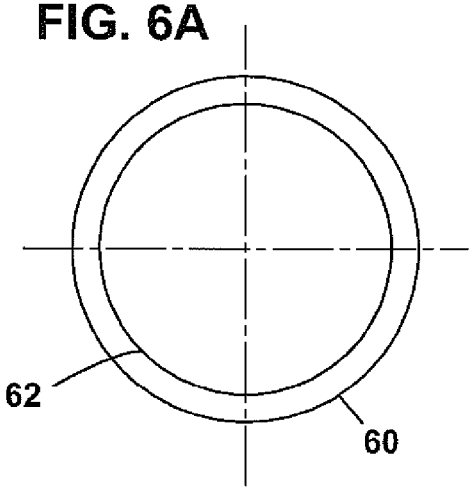
FIG. 6 illustrates a screw tip envelope of a rotor in accordance with the invention with respect to a piston-ring seal mounted on the rotor with the rotor aligned with the liner (FIG. 6A) and with the rotor deflected with respect to the liner (FIG. 6B)
Figure 6B:
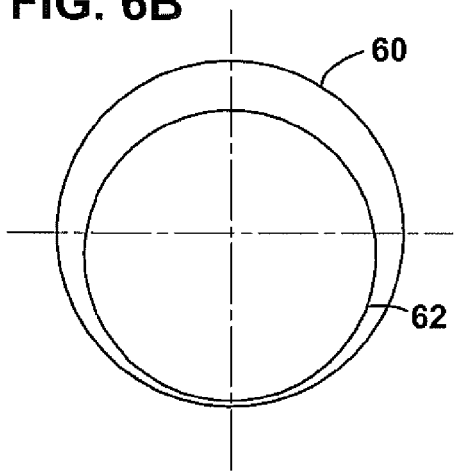

In addition, as illustrated in FIGS. 6A and 6B, the dimensions of the groove 48 and ring seal 60 are selected such that the contact of the outer surface 50 of the ring seal 60 with the inside surface 49 of the pump liner 51 is accomplished when the rotor is aligned with the pump liner (as illustrated in FIG. 6A by the outer edge of the ring seal 60) and with the rotor deflected with respect to the liner (FIG. 6B). In FIGS. 6A and 6B, a screw tip envelope 62 is illustrated with the fully deflected ring seal 60 disposed in the groove 48 at the tip of the screw threads 44.

As understood by those of ordinary skill in the applicable arts, in pumps with a twin-screw architecture, rotor deflection varies as the third power of the rotor length. As such, the pressure rise per stage has been limited by the need to provide sufficient clearance between the rotor and the surrounding liner because as the pressure rise increases the rotor deflects proportionately and this correspondingly requires a larger circumferential clearance to prevent any catastrophic rubs. Current technology limits the pressure rise to approximately 6-8 bars per stage and achieving a higher pressure boost requires longer rotors with significantly higher deflections. With the reduction and/or elimination of slip pump flow provided by the ring seal of the instant invention, the pressure rise per stage is increased, allowing a more compact rotor to be designed for a desired overall pressure rise.

As such, the pump rotor 40 according to the disclosed invention will minimize and/or eliminate pump slip flow between the rotor and the casing, resulting in a high-pressure differential boost multiphase pump with a compact rotor length. In addition, better sealing between the edges of the rotor and the pump casing will also insure a reduction in solid particulate erosion/abrasion of rotor tips as well as providing allowance for thermal expansion mismatch when pumping transport fluids with a high gas-volume fraction, thus also reducing the likelihood of catastrophic seizures. In addition, the ride-through operation of the twin screw pump when slugs of high gas volume fraction are present in the well-head flows may be enhanced by using variable speed drives and clearance control logic.

Figure 7:
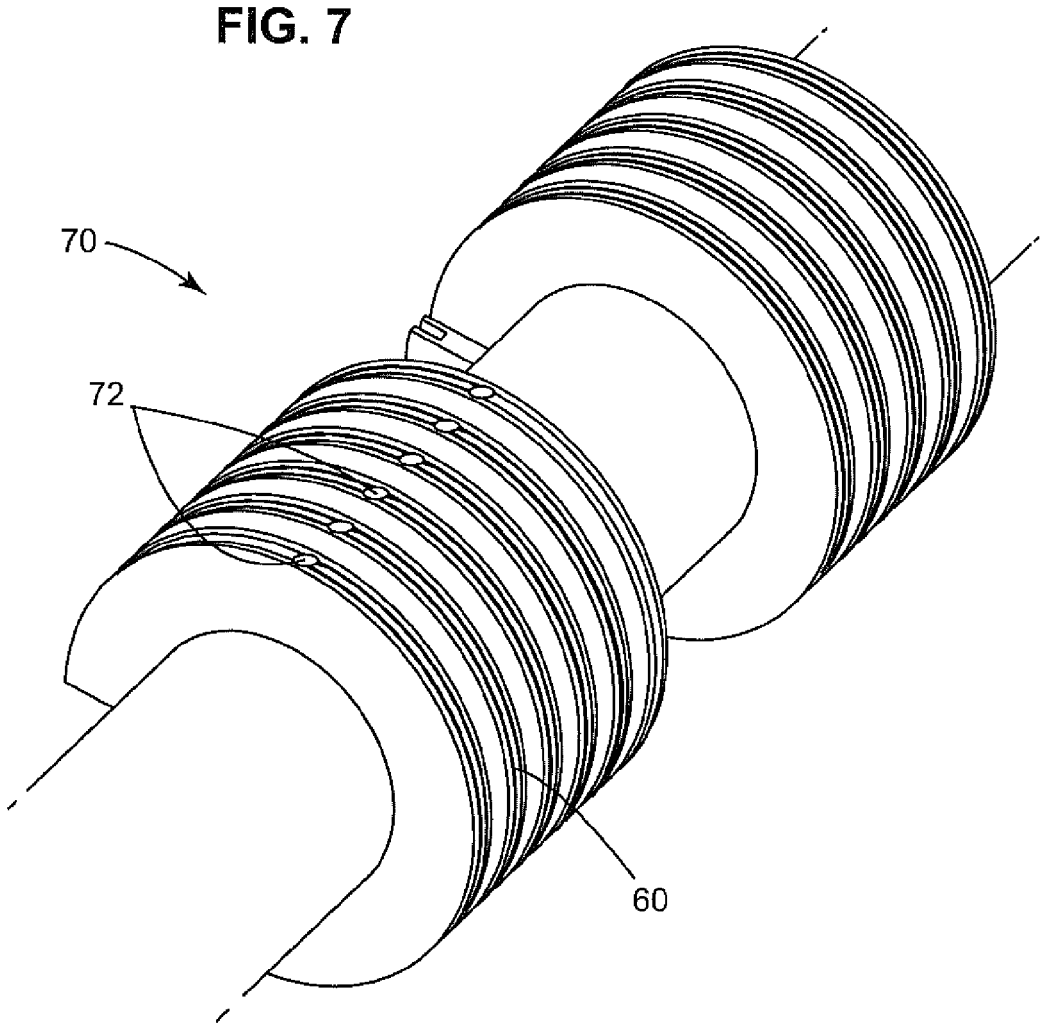
FIG. 7 illustrates a perspective view of a rotor in accordance with another embodiment of the disclosed invention.

Another embodiment of a rotor 70 of the instant invention is illustrated in FIG. 7. As shown, pins 72 are used to hold the ring seal 60 in place inside and with respect to the grooves 48 when the rotor 70 is rotated, such pins 72 acting as anti-rotation constraints. As shown, the ring seals 60 are held in place by pins 72 disposed once per revolution (or any multiple or fraction there of, depending on the circumferential length of the seals). In addition, in embodiments having more than one set of threads 44, the pins 72 are disposed in the first set of threads 44 at a circumferential location opposite to the circumferential location in which the pins 72 are disposed in the second set of threads 44 or otherwise optimal to insure proper balance when the rotor 70 rotates. In embodiments having multiple rings in each set of threads, a first pin is disposed on a first end of the ring seal and a second one at the second end thereof. The second ring is then disposed against the second pin holding the second end of the first ring and so on. As explained, during operation of the pump, the shaft deflects and rubs against the side surfaces of the piston ring, or ring seal 60. The outside diameter of the piston ring is in constant contact with the liner bore, thus maintaining the seal. Contact with the liner bore (in spite of seal wear) is maintained by virtue of the ring seal's out-springing effect and/or centrifugal loads on the ring as the rotor rotates.

Figure 8:
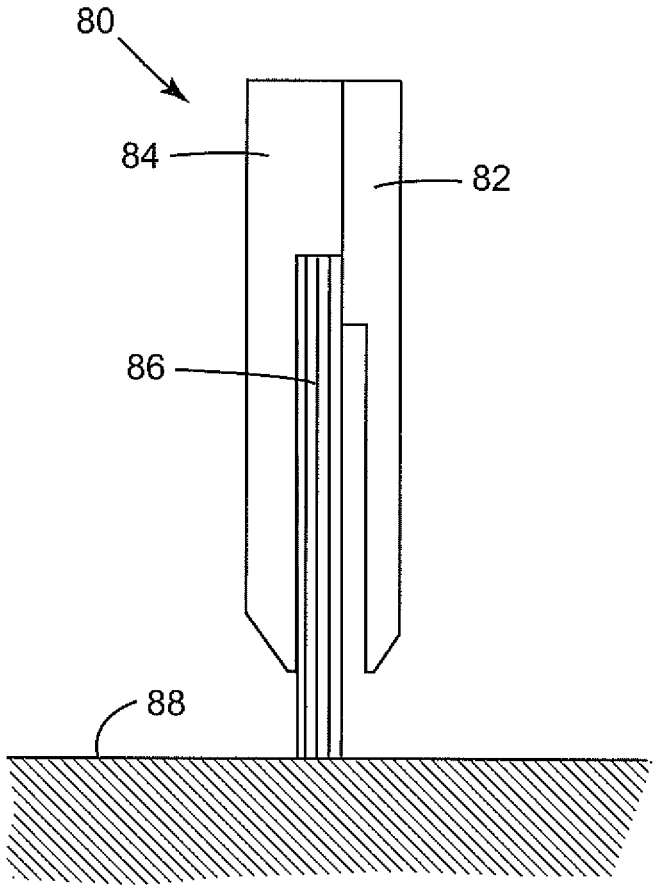
FIG. 8 illustrates a cross sectional view of another rotor seal in accordance with another embodiment of the invention.

As shown in FIG. 8, another version of the inter-stage seal in accordance with the disclosed invention is a brush seal 80 installed on the screw rotor OD. As illustrated, the inter-stage brush seal 80 includes front and back plates 82, 84 holding a bristle pack 86 therebetween, the bristle pack 86 being held against the casing 88 to minimizing the passage of flow from one side of the brush to the other.

The thermal design of the rotor/liner interface which enables operation of the twin screw pump under wet gas compression conditions by using rotor materials which have low thermal coefficient of expansion compared to the liner bore is also within the scope of the disclosed invention. For example, the use of a specific rotor material, such as invar, which has a low thermal coefficient of expansion, enables the pump to ride through a gas slug within a minimum amount of deflection due the thermal heating. In another embodiment of the invention, a longer mean time between failure, or MTBF, is achieved by selecting the material of the ring seal 60 so as to allow the ring seal to be a sacrificial wear component, while simultaneously guaranteeing the rated design pressure/flow rate conditions.

Methods of reducing slip flow in a screw pump are also within the scope of the embodiments of the invention disclosed, the screw pump having a casing having a low-pressure inlet and a high-pressure outlet, a liner disposed inside of the casing, and a rotor disposed inside of the liner having a shaft and a first set of threads disposed on a portion of an outer surface of the shaft. Such methods include the steps of forming a groove on an end portion of at least one thread of the first set of threads, and disposing a ring seal on the groove, the ring seal being configured to protrude outwardly from the groove and to rest against an inner surface of the liner of the screw pump, the groove being sized so as to allow the ring seal to move radially with respect to the at least one thread of the first set of threads as the rotor is deflected, and the ring seal being configured to reduce the slip flow from the high-pressure outlet to the low-pressure inlet.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

In addition, while the present invention has been shown in the drawings and fully described above with particularity and detail in connection with what is presently deemed to be practical and several of the preferred embodiments of the invention, it will be apparent to those of ordinary skill in the art who review this disclosure that many modifications are possible (as for example, but not as a limitation, variations in sizes, dimensions, structures, shapes and proportions of the various elements, values of parameters, mounting arrangements, use of materials, and orientations, to name a few) without materially departing from the novel teachings, the principles and concepts set forth herein, and advantages of the subject matter recited in the appended claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the embodiments of the invention as expressed in the appended claims. Hence, the proper scope of the present invention should be determined only by the broadest interpretation of the appended claims so as to encompass all such modifications and equivalents.

The invention claimed is:

1. A pump rotor for a screw pump, the pump rotor comprising:

a shaft;

a first set of threads disposed on a portion of an outer surface of the shaft, at least one thread of the first set of threads comprising a groove disposed on an end portion thereof;

a first seal disposed on the groove;

the first seal configured to rotate with the shaft;

first and second pins disposed in the groove of the at least one thread of the first set, a first end of the first seal being disposed against the first pin and a second end of the first seal being disposed against the second pin;

a second seal disposed on the groove;

the second seal configured to rotate with the shaft; and a first end of the second seal being disposed against the second pin and a second end of the second seal being disposed against a third in disposed in the groove of the at least one thread of the first set of threads.

2. The pump rotor according to claim 1, wherein the seal is a brush seal.

3. The pump rotor according to claim 1, wherein the first seal is a first ring seal.

4. The pump rotor according to claim 3, wherein the first ring seal is configured to protrude outwardly from the groove and to rest against an inner surface of a liner of the screw pump, and the groove is sized so as to allow the first ring seal to move radially with respect to the at least one thread as the rotor is deflected.

5. The pump rotor according to claim 4, wherein the first ring seal and the first set of threads are helical.

6. The pump rotor according to claim 3, wherein the first ring seal is a sacrificial wear component of the pump rotor.

7. A twin-screw pump, comprising:

a casing having an inlet and an outlet;

a liner disposed inside of the casing; and two rotors disposed inside of the liner, each rotor comprising, a shaft;

a set of threads disposed on a portion of an outer surface of the shaft, at least one thread of a first set of threads comprising a groove disposed on an end portion thereof; and a first ring seal disposed on the groove, wherein the first ring seal is configured to rotate with the respective shaft; and first and second pins disposed in the groove of the at least one thread of the first set, a first end of the first ring seal being disposed against the first pin and a second end of the first ring seal being disposed against the second pin;

a second ring seal disposed on the groove;

the second ring seal configured to rotate with the shaft; and a first end of the second ring seal being disposed against the second pin and a second end of the second ring seal being disposed against a third pin disposed in the groove of the at least one thread of the first set of threads.

8. The pump according to claim 7, wherein each first ring seal is configured to protrude outwardly from the groove and to rest against an inner surface of the liner, and the groove is sized so as to allow each first ring seal to move radially with respect to the at least one thread of the first set of threads as the rotor is deflected.

9. The pump according to claim 7, wherein each first ring seal and the set of threads are helical.

10. A pump rotor for a screw pump, the pump rotor comprising:

a shaft;

a first set of threads disposed on a portion of an outer surface of the shaft, at least one thread of the first set of threads comprising a groove disposed on an end portion thereof;

a first ring seal disposed on the groove;

the first ring seal configured to rotate with the shaft;

first and second pins disposed in the groove of the at least one thread of the first set, a first end of the first ring seal being disposed against the first pin and a second end of the first ring seal being disposed against the second pin;

a second seal extending about one complete circumferential revolution disposed on the groove;

the second seal configured to rotate with the shaft; and a first end of the second seal being disposed against the second pin and a second end of the second seal being disposed against a third pin disposed in the groove of the at least one thread of the first set of threads.

11. A pump rotor for a screw pump, the pump rotor comprising:

a shaft;

a first set of helical threads disposed on a portion of an outer surface of the shaft, at least one thread of the first set of threads comprising a groove disposed on an end portion thereof;

a helical first ring seal disposed on the groove;

the helical first ring seal configured to rotate with the shaft and to protrude outwardly from the groove and to rest against an inner surface of a liner of the screw pump, and the groove is sized so as to allow the first ring seal to move radially with respect to the at least one thread as the rotor is deflected;

first and second pins disposed in the groove of the at least one thread of the first set, a first end of the first seal being disposed against the first in and a second end of the first seal being disposed against the second pin;

multiple ring seals including at least a second ring seal, each extending about one complete circumferential revolution, disposed sequentially on the groove subsequent to the first ring seal substantially the complete helical length of the first set of threads and configured to rotate with the shaft;

a first end of the second ring seal being disposed against the second pin and a second end of the second seal being disposed against a third pin disposed in the groove of the at least one thread of the first set of threads; and subsequent of the multiple ring seals each having a first end disposed against the previous pin and a second end of each subsequent of the multiple ring seals disposed against a next pin disposed in the groove of the at least one thread of the first set of threads.

12. A twin-screw pump, comprising:

a casing having an inlet and an outlet;

a liner disposed inside of the casing; and two rotors disposed inside of the liner, each rotor comprising, a shaft;

a set of threads disposed on a portion of an outer surface of the shaft, at least one thread of a first set of threads comprising a groove disposed on an end portion thereof; and a first ring seal disposed on the groove, wherein the first ring seal is configured to rotate with the respective shaft; and first and second pins disposed in the groove of the at least one thread of the first set, a first end of the first ring seal being disposed against the first pin and a second end of the first ring seal being disposed against the second in wherein the first ring seal disposed on the groove of each rotor shaft first set of threads extends about one complete circumferential revolution, each rotor further comprising:

a second ring seal extending about one complete circumferential revolution disposed on the groove;

the second ring seal configured to rotate with the shaft; and a first end of the second seal being disposed against the second pin and a second end of the second seal being disposed against a third pin disposed in the groove of the at least one thread of the first set of threads.

* * * * *